US007371984B2

(12) United States Patent
Lee et al.

(10) Patent No.: US 7,371,984 B2
(45) Date of Patent: May 13, 2008

(54) BUTTON ASSEMBLY OF DISHWASHER

(75) Inventors: Yong Jae Lee, Woolsan-si (KR); Yong Hee Kim, Kyungsangnam-do (KR)

(73) Assignee: LG Electronics Inc., Seoul (KR)

( * ) Notice: Subject to any disclaimer, the term of this patent is extended or adjusted under 35 U.S.C. 154(b) by 63 days.

(21) Appl. No.: 11/255,178

(22) Filed: Oct. 21, 2005

(65) Prior Publication Data

US 2007/0089972 A1 Apr. 26, 2007

(51) Int. Cl.
*H01H 9/00* (2006.01)

(52) U.S. Cl. ..... 200/296; 200/343

(58) Field of Classification Search ..... 200/5 A, 200/296, 341–343; 341/22; 345/168, 169
See application file for complete search history.

(56) References Cited

U.S. PATENT DOCUMENTS 5,749,457 A * 5/1998 Castaneda et al. ..... 200/343
5,813,520 A * 9/1998 Reier et al. ..... 200/343
6,054,662 A * 4/2000 Hrehor et al. ..... 200/332
6,633,011 B2 * 10/2003 Ogawa et al. ..... 200/343
6,914,206 B2 * 7/2005 Mukougawa ..... 200/556
6,960,734 B1 * 11/2005 Park ..... 200/343
6,964,532 B1 * 11/2005 Lu ..... 400/490
7,002,086 B2 * 2/2006 Fuji ..... 200/305
7,098,417 B1 * 8/2006 Fuji ..... 200/343
7,102,090 B2 * 9/2006 Morisada ..... 200/296
7,189,932 B2 * 3/2007 Kim ..... 200/5 R

* cited by examiner

*Primary Examiner*—Michael A Friedhofer
(74) *Attorney, Agent, or Firm*—McKenna Long & Aldridge LLP

(57) ABSTRACT

A button assembly of a dishwasher is provided. The button assembly includes a button portion and a front panel. The button portion has a button head for a user to press and a button body extending down from the button head. A button connecting portion connects a plurality of button bodies, and hence, a plurality of button portions along one piece. The button portion is installed at the rear of the front panel. The front panel has a button window formed therein for inserting the button head therethrough. Because the button portions do not need to be individually mounted using individual springs and fasteners, the assembly process is simplified, and manufacturing cost is reduced.

11 Claims, 8 Drawing Sheets

"Prior Art"

BUTTON ASSEMBLY OF DISHWASHER

BACKGROUND OF THE INVENTION

1. Field of the Invention

The present invention relates to a dishwasher, and more particularly, to a button assembly of a dishwasher for a user to input commands with, in order to control the operation of the dishwasher.

2. Description of the Related Art

In general, dishwashers are convenient kitchen appliances that clean and remove food deposits from dishes using high-pressure streams of water and detergent, and also dry the dishes afterwards.

A dishwasher typically has a control panel, located on its frontal portion, including a button assembly for entering operation commands and an LED (light emitting diode) display for showing the operation mode. A user presses the buttons on the control panel to enter operational commands.

FIG. 1 is a perspective view of a button assembly in a control panel of the prior art.

Referring to FIG. 1, the button assembly of the prior art includes a front panel 10 and a plurality of buttons 20 installed at the back of the front panel 10. The front panel 10 includes a button window 11, allowing a user to press the buttons 20 inserted through the button window 11.

In addition, attached to the rear of a button 10 are a leaf spring 30 having a predetermined elasticity, and a fastening screw 40 fastening the button 20 and the leaf spring 30 in one unit to the rear of the front panel 10.

Accordingly, when a user presses a button 20, the leaf spring 30 flexes, and when the user releases the button 20, the tension in the leaf spring 30 causes the button 20 to return to its original position.

In this button assembly of the prior art, not only is an individual leaf spring required to maintain spring tension for each button, but a fastening screw is also required to fasten each spring to each button.

Because each button needs to be installed with its own leaf spring and fastened with its own fastener, the number of parts needed to form the button assembly increases, and the assembly process is unnecessarily complicated.

SUMMARY OF THE INVENTION

Accordingly, the present invention is directed to a button assembly of a dishwasher that substantially obviates one or more problems due to limitations and disadvantages of the related art.

To solve the above problems, the present invention provides an improved button assembly of a dishwasher having a reduced manufacturing cost and a simplified manufacturing process.

According to an aspect of the present invention, there is provided a button assembly of a dishwasher including: a front panel having a button window formed therein; a button portion having a button head inserted through the button window for a user to press and a button body extending down from the button head; and a connecting portion formed at the base of the button body, for installing the button portion on the rear of the front panel.

According to another aspect of the present invention, there is provided a button assembly of a dishwasher including: a button portion having a button head that a user can press, a button body extending down from the button head, a hinge formed at the base of the button body, and an arm protruding from one side of the hinge; and a front panel for installing the button portion at its rear, and having a button window for inserting the button head through.

According to a further aspect of the present invention, there is provided a button assembly of a dishwasher including: a button head having a protruding portion protruding a predetermined length from its top; a button body extending down from the lower portion of the button head; a button connecting portion disposed horizontally to the lower portion of the button body for connecting a plurality of buttons along a single unit; and a front panel for installing the button connecting portion to its rear, and having a button window for inserting the button head through and a button guide at the upper portion of the button window for guiding the protruding portion.

An advantage of the button assembly of a dishwasher of the present invention is that the button assembly is simplified.

Also, the number of parts needed for the button assembly is reduced, simplifying the assembly process and reducing manufacturing cost.

BRIEF DESCRIPTION OF THE DRAWINGS

The spirit of the present invention can be understood more fully with reference to the accompanying drawings. In the drawings.

DETAILED DESCRIPTION OF THE INVENTION

Hereinafter, preferred embodiments of a button assembly of a dishwasher according to the present invention will be described in detail with reference to the accompanying drawings. While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

Figure 1:
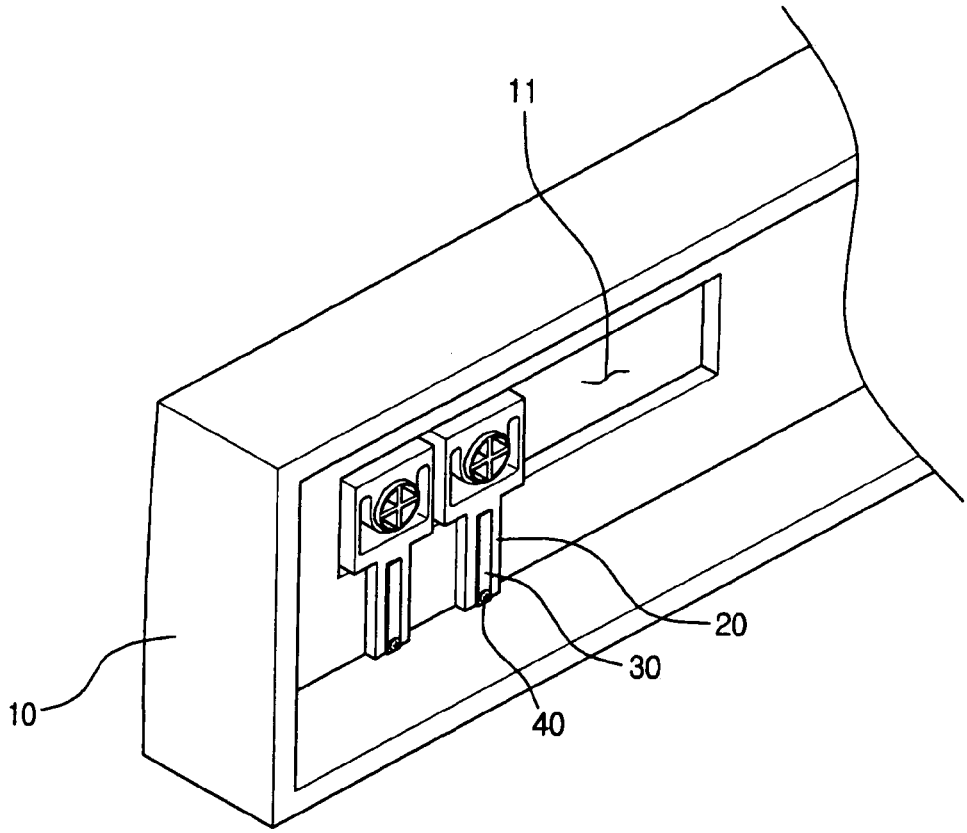
FIG. 1 is a perspective view of a button assembly in a control panel of the prior art.
Figure 2:
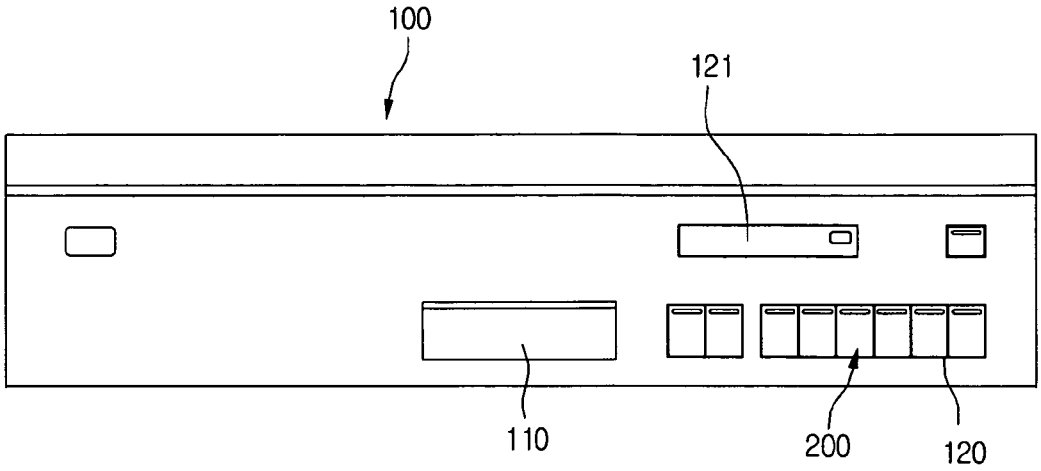
FIG. 2 is a frontal view of a front panel of a dishwasher according to the present invention.
Figure 3:
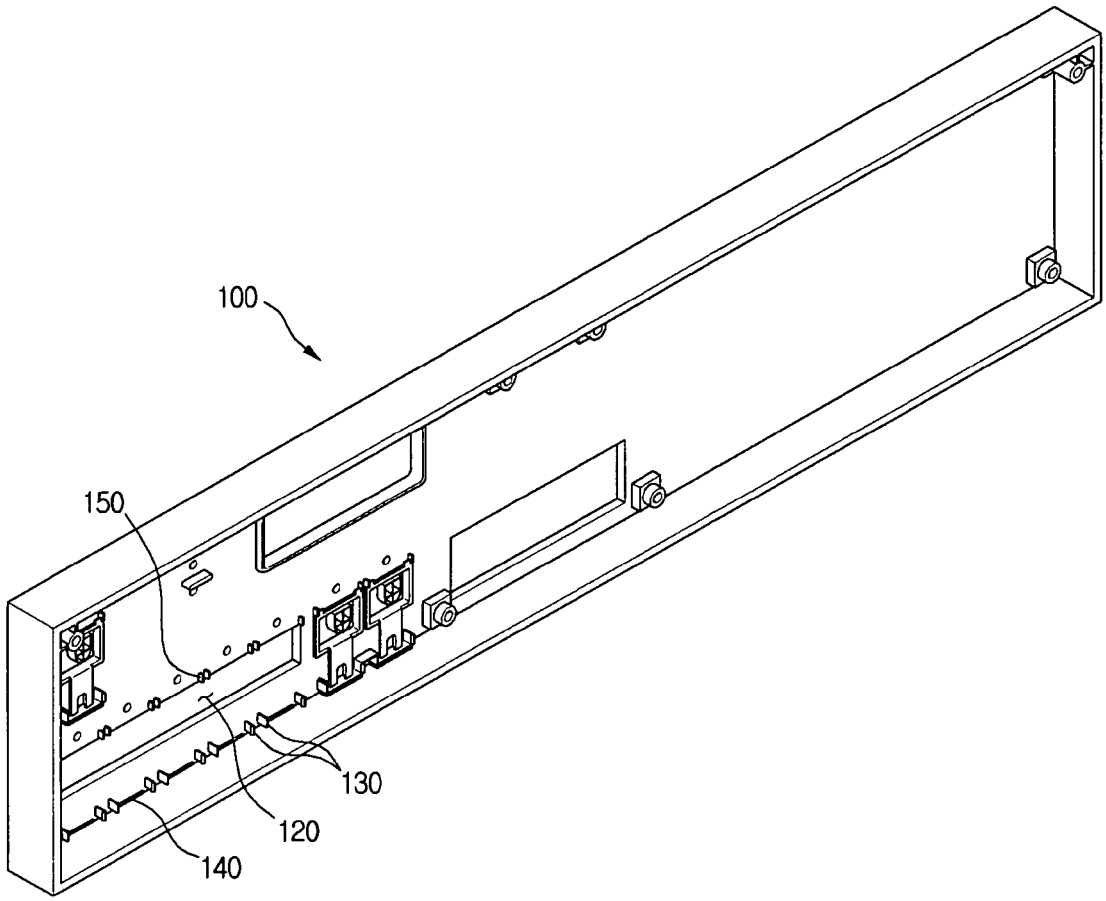
FIG. 3 is a perspective view of the rear of the front panel in FIG. 2.

FIG. 2 is a frontal view of a front panel of a dishwasher according to the present invention, and FIG. 3 is a perspective view of the rear of the front panel in FIG. 2.

Referring to FIGS. 2 and 3, the door of the dishwasher of the present invention includes a front panel 100 disposed at the top portion of the door, and a handle for opening and closing the door centrally disposed on the door.

Formed on one area of the front panel 100 is a button window 120 for inserting a button portion therein. On another portion of the front panel 100 is a display portion window 121 for displaying the operation status of the washing and drying cycles of the dishwasher. Inserted in the button window 120 is the button portion 200 according to the present invention.

Also, the front panel 100 of the button assembly according to the present invention further includes a plurality of coupling catches 130 formed on the bottom of the button window 120. In further detail, the coupling catch 130 comes in more than one inwardly facing pair of catches, with each pair separated by a predetermined distance.

The front panel 100 also includes a plurality of button guides 150 at the upper portion of the button window 120. Specifically, the button guides 150 prevent lateral movement of the button portion 200, when it is installed in the button window, by guiding both sides of the button's upper portion.

According to the above embodiment of the present invention, the button portion 200 is installed at the rear of the front panel 100, fixed via the coupling catch 130 and the button guide 150. When the button portion 200 inserted through the button window 120 is pressed, the operational commands can be inputted into the dishwasher.

Figure 4:
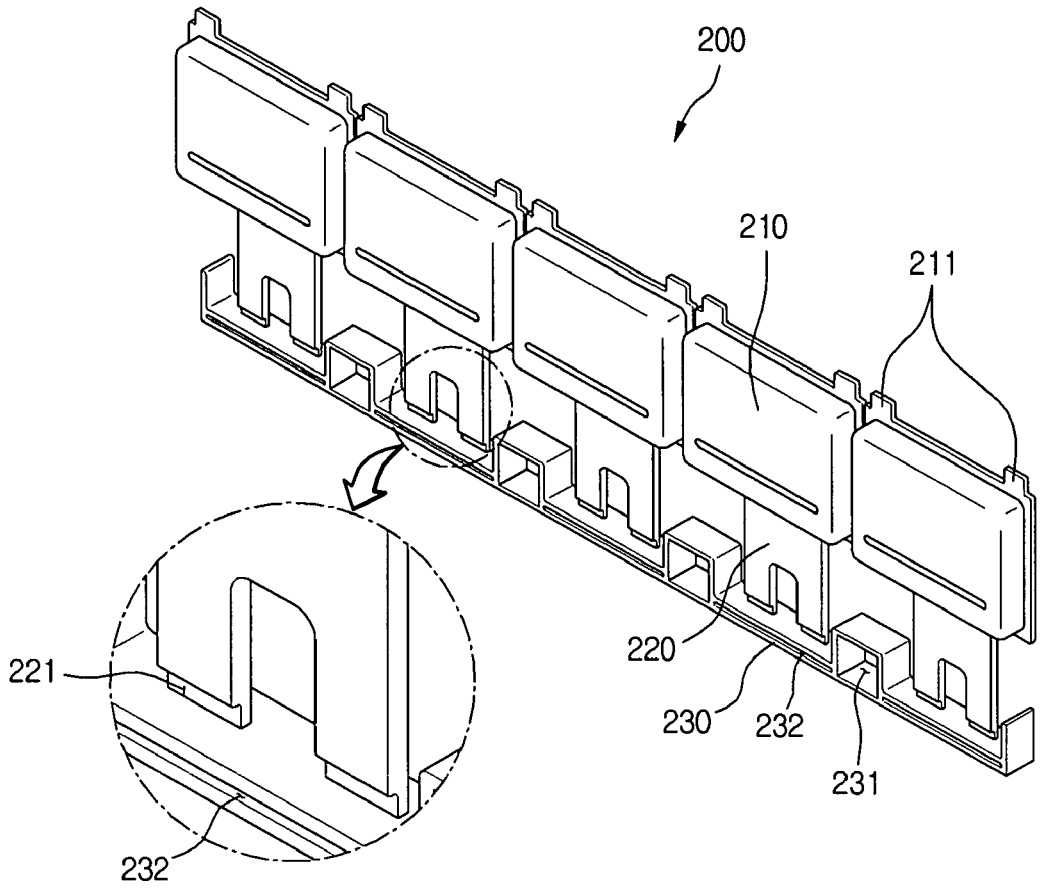
FIG. 4 is a perspective view of the button portion according to the present invention.

FIG. 4 is a perspective view of the button portion according to the present invention.

Referring to FIG. 4, the button portion 200 of the present invention includes a button head 210 that inserts into the button window 120 of the front panel 100 to be pressed by a user, and a button body 220 formed on the button head 210 extending a predetermined length down from the button head 210. In further detail, the button body 220 has a predetermined inherent elasticity, so that when a user presses the button head 210, the button body 220 leans back a corresponding distance, then springs forward again when the button head 210 is released. Furthermore, there is a notched portion 221 at the frontal base of the button body 220, notched slightly so that the button body 220 is able to flex more readily.

At the lower portion of the button body 220 is a button connecting portion 230 horizontally formed. Specifically, in order for a guide rib 140 that protrudes from the rear of the front panel 100 to be inserted in the button connecting portion 230, a guide rib insertion slot 232 is formed in the button connecting portion 230. Furthermore, in the spaces between the button bodies 220, catch insertion portions 231 that are roughly square in shape are formed, so that the coupling catches 130 can be inserted therein. The end of the coupling catch 130 is formed so that it is caught by the side of the catch insertion portion 231, preventing the disengagement of the button portion 200 from the front panel 100, following installation.

Figure 5:
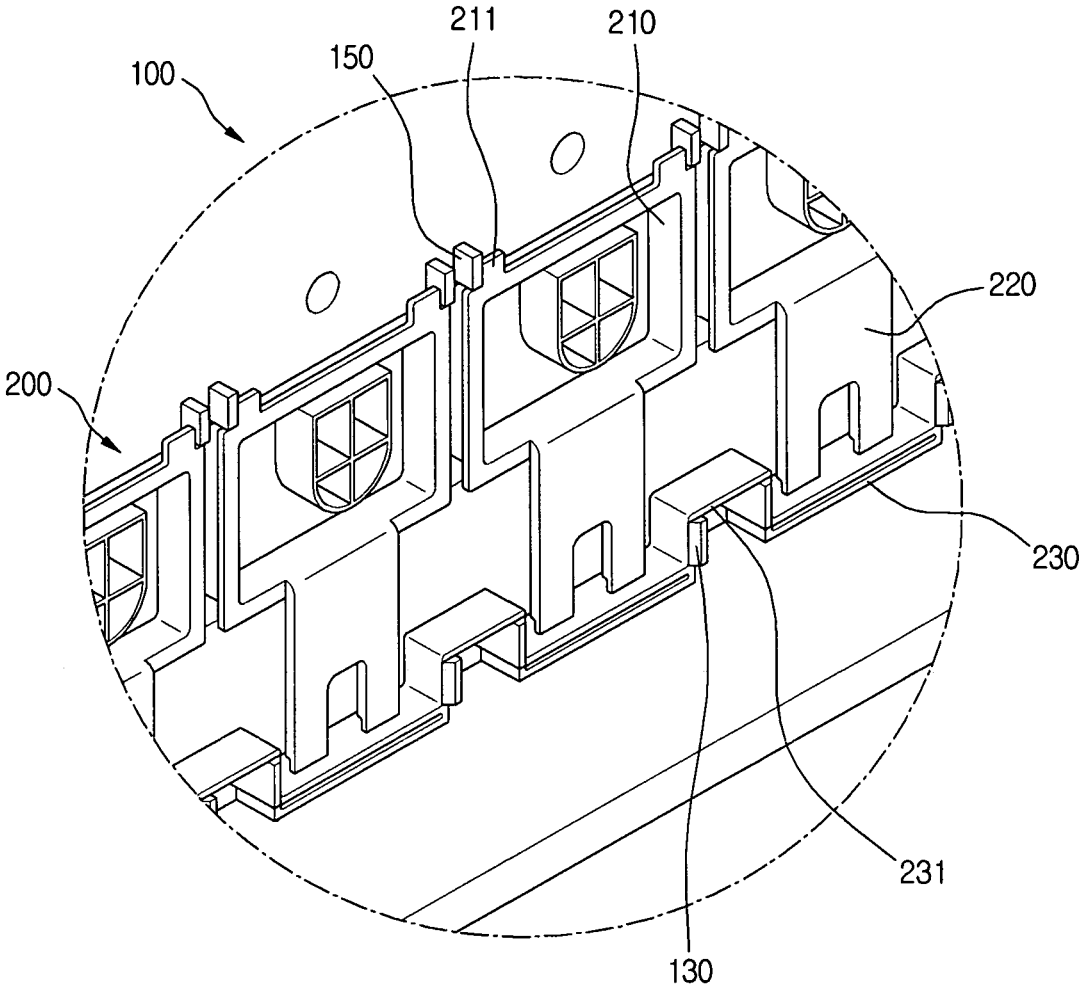
FIG. 5 is a perspective view of the button portion installed in the rear of the front panel according to the present invention.

FIG. 5 is a perspective view of the button portion installed in the rear of the front panel according to the present invention.

Referring to FIG. 5, the process of attaching the button portion 200 to the front panel 100 will now be described.

First, the guide rib 140 formed at the rear of the front panel 100 is inserted into the guide rib insertion slot 232 formed on the button connection portion 230; and at the same time, the coupling catch 130 is inserted through the catch insertion portion 231. More specifically, a pair of coupling catches 130 are inserted along the inner walls of the catch insertion portion 231 until the hooked portions of the ends of the coupling catch 130 are caught by the ends of the walls of the catch insertion portion 231. Also, when the protruding portions formed at the ends of the coupling catches 130 are caught by the ends of the walls of the catch insertion portion 231, a clicking noise can be heard.

Here, when the button portion 200 is completely inserted into the front panel 100, the alignment bosses 211 protruding from both sides of the upper portion of the button head 210 come into contact with the sides of the button guides 150. Consequently, when the button head 210 returns to its original position after being pressed and released, the button head will not move laterally, but will retain a constant central resting position.

Figure 6:
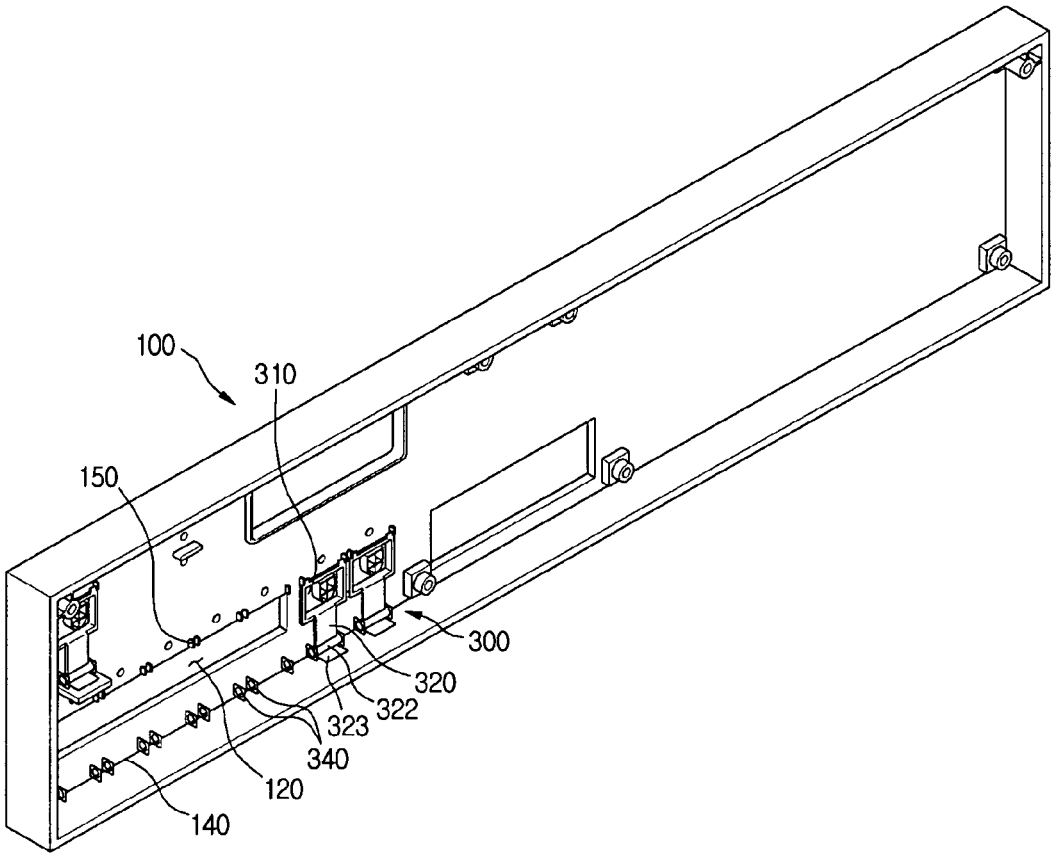
FIGS. 6 through 8 show a button assembly according to another embodiment of the present invention.
Figure 7:
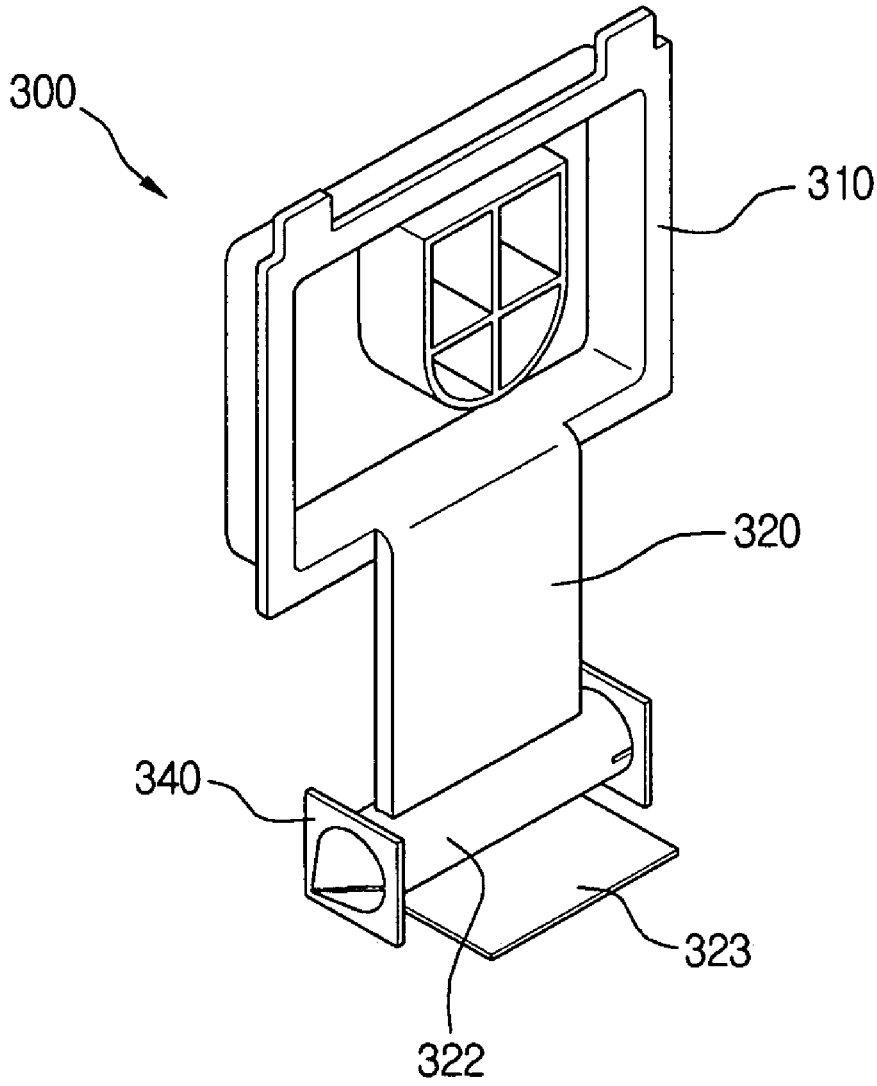
Figure 8:
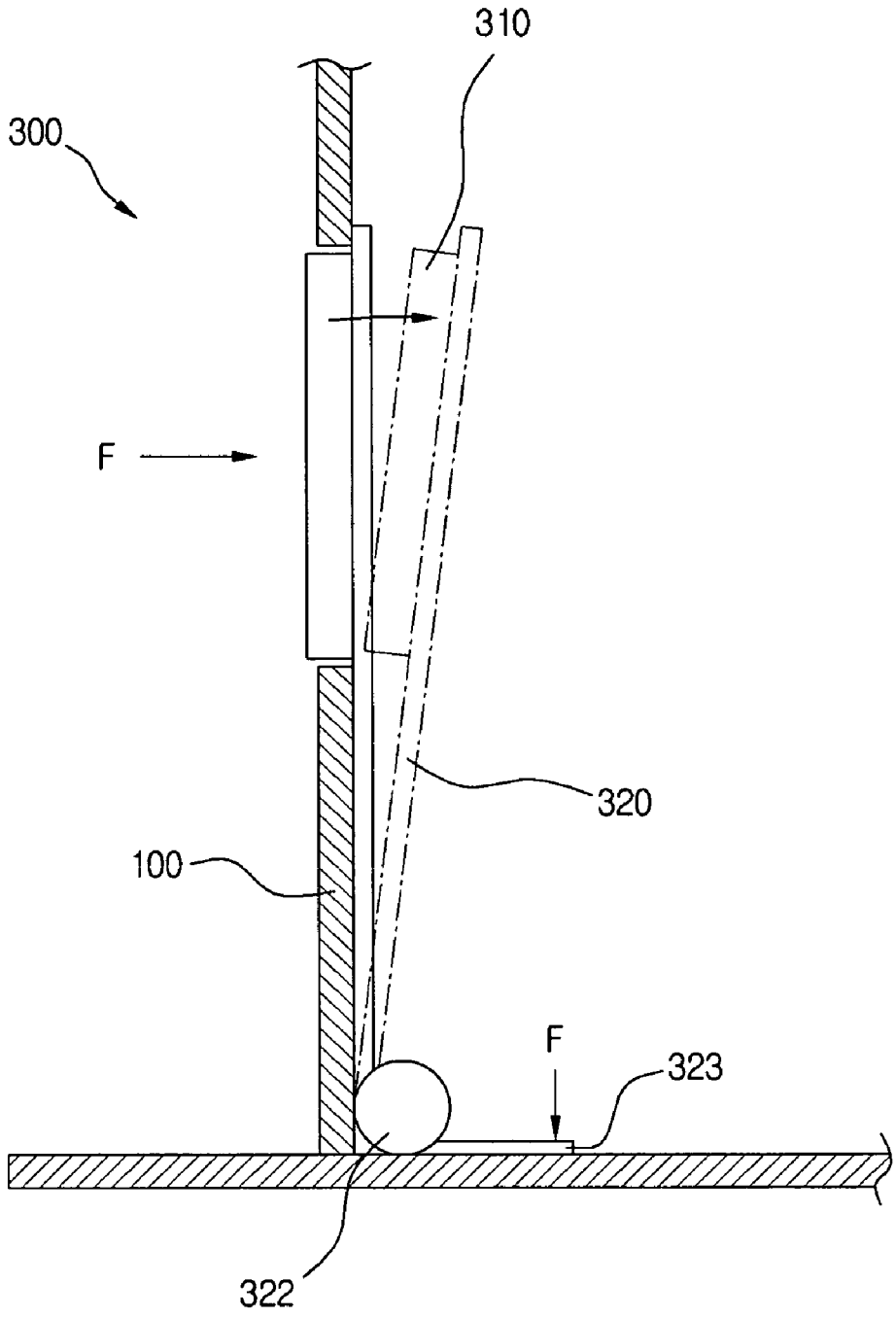

FIGS. 6 through 8 show a button assembly according to another embodiment of the present invention.

Referring to FIGS. 6 and 7, the button portion 300 of the present invention includes a hinge 322 horizontally disposed at the lower portion of the button body 320 and having a predetermined diameter and length. On one side of the hinge 322 is an arm 323 extending at roughly a right angle to the button body 320. At each end of the hinge 322 is a hinge mount 340 for mounting the hinge 322 thereon. The button body 320 and the arm 323 may be injection molded in one piece with the hinge 322.

The hinge 322 may have a simple cylindrical shape, as shown in FIG. 6, or its ends may deviate from roundness, in order to prevent their disengagement from the hinge mounts 340, as shown in FIG. 7.

Referring to FIG. 8, when a user applies a predetermined force (F) to the button head 320, the button body 320 reclines as far back as a predetermined angle. In other words, the angle between the button body 320 and the arm 323 decreases. As the button body 320 reclines, the arm 323 exerts the same force (F) downward on the bottom of the front panel 100. Furthermore, when the force applied to the button head 310 is removed, the elasticity in the arm 323 causes the button body 320 to return to a disposed angle of 90 degrees relative to the arm 323.

If a button portion 300 using the arm 323 and hinge 322 is implemented, the leaf spring at the back of the button body of the prior art does not need to be individually installed, thus simplifying the assembly process. Because the arm 323 is formed in one piece with the button body 320, the manufacturing cost can also be reduced.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. A button assembly of a dishwasher, comprising:

a front panel having a button window formed therein;

at least one button portion including a button head inserted in the button window for a user to press and a button body having a first thickness and extending down from the button head; and a connecting portion formed on a lower portion of the button body for attaching the button portion to a rear of the front panel, the button body having a second thickness, less than the first, adjacent to the connecting portion, wherein the connecting portion defines at least one guide rib insertion slot recessed with a predetermined depth extending substantially along a majority of a longitudinal length of a front side of the connecting portion, and the front panel includes at least one guide rib protruding from a rear for insertion into the guide rib insertion slot.

2. The button assembly according to claim 1, wherein the connecting portion is extended to connect a plurality of buttons portions along one piece.

3. The button assembly according to claim 1, wherein the button head includes at least one alignment boss protruding a predetermined distance from one end of the button head.

4. The button assembly according to claim 1, wherein the button body is reduced from the first thickness to the second thickness along a notched portion having a predetermined depth and formed along the lower portion of the button body.

5. The button assembly according to claim 1, wherein the connecting portion includes a catch insertion portion for firmly installing the button portion to the front panel, and the front panel has a rear including a coupling catch protruding therefrom for inserting into the catch insertion portion.

6. The button assembly according to claim 1, wherein the front panel includes at least two button guides on an upper portion at a rear of the button window.

7. A button assembly of a dishwasher, comprising:

a button portion, comprising:

a button head including an alignment boss protruding a predetermined distance from a top of the button head;

a button body having a first thickness and extending down from the button head;

a button connecting portion formed horizontally at a lower portion of the button body for connecting a plurality of button portions along one piece, the button body having a second thickness, less than the first, adjacent to the connecting portion, wherein the connecting portion defines at least one guide rib insertion slot recessed with a predetermined depth extending substantially along a majority of a longitudinal length of a front side of the connecting portion, and the front panel includes at least one guide rib protruding from a rear for insertion into the guide rib insertion slot; and a front panel including a rear to which the button connecting portion is mounted, the front panel including a button window for inserting the button head therein and a guide rib protruding from an upper portion at a rear of the button window for guiding the alignment boss.

8. The button assembly according to claim 7, wherein the front panel includes a coupling catch protruding a predetermined distance from a rear surface thereof, and the button connecting portion includes a catch insertion portion of a predetermined size formed beside the button body for receiving the coupling catch therein.

9. The button assembly according to claim 7, wherein the button body includes a notched portion notched at a predetermined depth and formed along a lower front end of the button body, the notched portion providing a predetermined elasticity when the button head is pressed on by an outside force.

10. A button assembly of a dishwasher, comprising:

a front panel having a button window formed therein;

at least one button portion including a button head inserted in the button window for a user to press and a button body having a first thickness and extending down from the button head; and a connecting portion formed on a lower portion of the button body for attaching the button portion to a rear of the front panel, the button body having a second thickness, less than the first, adjacent to the connecting portion, wherein the connecting portion includes a hinge horizontally connected to a lower portion of the button body and an arm extending from a rear side of the hinge, substantially along the length of the hinge.

11. The button assembly according to claim 10, wherein the front panel includes a hinge mount formed on a rear for pivotably mounting the hinge to the front panel.

* * * * *